US011524309B2

(12) United States Patent
Boerner

(10) Patent No.: US 11,524,309 B2
(45) Date of Patent: Dec. 13, 2022

(54) COMPONENT COATING

(71) Applicant: ABB Schweiz AG, Baden (CH)

(72) Inventor: Gunter Boerner, Sinsheim/Eschelbach (DE)

(73) Assignee: ABB Schweiz AG, Baden (CH)

( * ) Notice: Subject to any disclaimer, the term of this patent is extended or adjusted under 35 U.S.C. 154(b) by 441 days.

(21) Appl. No.: 16/527,055

(22) Filed: Jul. 31, 2019

(65) Prior Publication Data

US 2020/0023396 A1 Jan. 23, 2020

Related U.S. Application Data

(63) Continuation of application No. PCT/EP2018/050491, filed on Jan. 10, 2018.

(30) Foreign Application Priority Data

Feb. 1, 2017 (DE) ..... 102017101937.5

(51) Int. Cl.

| | |
|---|---|
| ***B05B 12/04*** | (2006.01) |
| ***B05B 13/04*** | (2006.01) |
| ***B41J 2/175*** | (2006.01) |

(52) U.S. Cl.

CPC ..... *B05B 12/04* (2013.01); *B05B 13/0452* (2013.01); *B41J 2/17596* (2013.01)

(58) Field of Classification Search

CPC ..... B05B 12/04; B41J 2/17596

See application file for complete search history.

(56) References Cited

U.S. PATENT DOCUMENTS

| | | | | |
|---|---|---|---|---|
| 5,602,575 | A * | 2/1997 | Pauly | B41J 2/04 347/54 |
| 5,618,347 | A * | 4/1997 | Clare | B05C 5/0279 118/313 |
| 10,150,304 | B2 | 12/2018 | Herre et al. | |
| 2005/0211195 | A1* | 9/2005 | Sundholm | F02M 25/028 123/25 A |
| 2011/0211029 | A1* | 9/2011 | Enomoto | B41J 2/17596 347/93 |
| 2012/0033003 | A1 | 2/2012 | Tanaka et al. | |

(Continued)

FOREIGN PATENT DOCUMENTS

| | | | |
|---|---|---|---|
| DE | 102008053178 | A1 | 5/2010 |
| DE | 102014013158 | A1 | 3/2016 |
| EP | 0138322 | A1 | 4/1985 |

*Primary Examiner* — Dah-Wei D. Yuan

*Assistant Examiner* — Stephen A Kitt

(74) *Attorney, Agent, or Firm* — Leydig, Voit & Mayer, Ltd.

(57) ABSTRACT

An application system for coating components with a coating agent can include: (i) an application apparatus including a printing head which ejects the coating agent from a plurality of coating agent nozzles, wherein a nozzle valve which opens for a valve opening time when a coating agent droplet is to exit the respective nozzle is attached to each individual coating agent nozzle; (ii) a coating agent infeed line by way of which the coating agent nozzles of the printing head are collectively connected; (iii) a valve control for controlling the valve opening times and valve closing times of each individual valve; and (iv) a pump by means of which the coating agent to be applied is fed to the coating agent nozzles by way of the coating agent infeed line.

5 Claims, 9 Drawing Sheets

(56) References Cited

U.S. PATENT DOCUMENTS

| | | | | |
|---|---|---|---|---|
| 2012/0249679 | A1* | 10/2012 | Beier | B05B 1/169 347/40 |
| 2013/0286114 | A1 | 10/2013 | Ito et al. | |
| 2015/0047562 | A1* | 2/2015 | Hirota | B05B 9/0423 118/313 |
| 2016/0074882 | A1 | 3/2016 | Büstgens | |

* cited by examiner

COMPONENT COATING

CROSS-REFERENCE TO RELATED APPLICATIONS

The present application is a continuation of International Application No. PCT/EP2018/050491 (filed on Jan. 10, 2018 and published as WO 2018/141511 on Aug. 9, 2018). The international application and publication are hereby incorporated by reference. The international application claims priority to German Application No. 10 2017 101 937.5 (filed on Feb. 1, 2017).

FIELD

Embodiments of the present invention relate to component coating.

BACKGROUND

A coating installation can include a robot on which at least the application apparatus is received. The application apparatus is usually received on the robot on the so-called tool center point (TCP).

DE 10 2008 053 178 A1 shows a coating installation for coating in particular paintwork of motor vehicle body components, In the case of such a painting plant for painting motor vehicle body components the motor vehicle body components to be painted are transported on a through a paint booth in which the motor vehicle body components then are painted by painting robots. The painting robots have one or a plurality of pivotable robotic arms and by way of a multi-axis robotic hand axis on the TCP of the former guide in each case one application apparatus.

The application apparatus here is embodied as a printing head which ejects the coating agent from a plurality of coating agent nozzles, and the coating agent nozzles of the printing head are collectively connected to a coating agent infeed line by way of which the coating agent to be applied is fed. The painting by means of such a printing head is advantageous, for example when a vehicle body is to be painted in multiple colors when different colors are to be applied to different locations on the body. The painting by way of a printing head applicator enables different zones on the workpiece, thus the body, for example, to be painted with contours having sharp peripheries without further additional precautions, in particular without masking regions of other color.

SUMMARY

Among other things, the present application discloses an application system for coating components with a coating agent. The application system can include: an application apparatus which applies the coating agent, wherein the application apparatus comprises a printing head which ejects the coating agent from a plurality of coating agent nozzles, wherein a nozzle valve which opens for a valve opening time when a coating agent droplet is to exit the respective nozzle is attached to each individual coating agent nozzle; a coating agent infeed line by way of which the coating agent nozzles of the printing head are collectively connected; a valve control for controlling the valve opening times and valve closing times of each individual valve; and a pump by means of which the coating agent to be applied is fed to the coating agent nozzles by way of the coating agent infeed line, and in that the application system is configured such that the pump during coating operates at a constant flow rate of the coating agent, and that the pressure on each nozzle when opening the valve is the same as in the preceding opening of said valve.

BRIEF DESCRIPTION OF THE DRAWINGS

Embodiments of the present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 5 further shows an exemplary temporal profile of the valve position during two complete switching periods T1 and T2, as well as during half a switching period T3; FIG. 5 further shows an exemplary temporal profile of the coating agent flow at the nozzle exit opening of a coating agent nozzle (solid line), and of the flow rate of the coating agent as imposed by the pump (dashed line); FIG. 5 further shows an exemplary temporal profile of the pressure on the coating agent nozzle of the printing head;

FIG. 6 further shows exemplary switched states of the nozzle valves according to FIG. 6 during two complete switching periods T1 and T2, as well as during half a switching period T3; FIG. 6 further shows an exemplary switched state of the return valve corresponding to the switched states of the nozzle valves as per FIG. 6, during two complete switching periods T1 and T2, as well as during half a switching period T3;

FIG. 8 further shows in a schematic and exemplary manner the operating mode of the coating agent nozzles of the printing head from FIG. 8, having the thirty-two coating agent nozzles 1-32.

DETAILED DESCRIPTION

Figure 1:
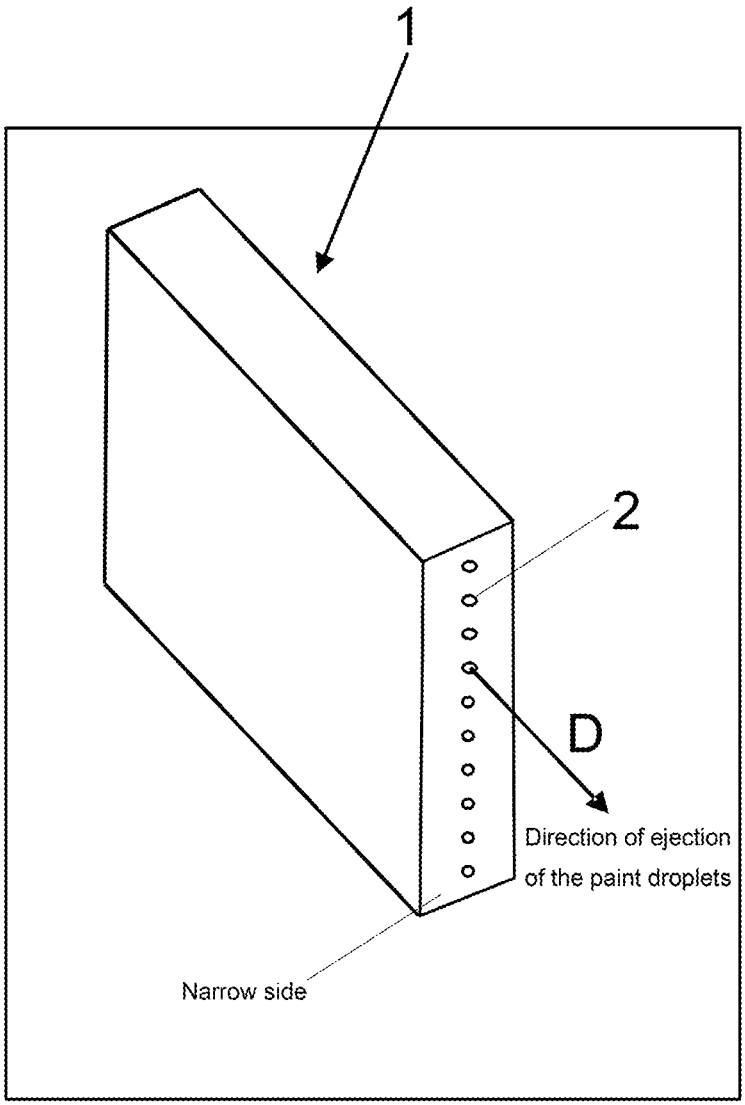
FIG. 1 in a schematic and exemplary manner shows a printing head for use in an application apparatus according to an embodiment of the invention, here having ten coating agent nozzles illustrated in an exemplary manner and disposed in a line behind one another, wherein the line extends so as to be approximately perpendicular to the direction of movement of the application apparatus when coating.

Embodiments of the present invention relate to an application system for coating components and to a coating installation.

The metering of the coating material when painting by way of a printing head applicator is usually performed by means of a pressure regulator for the coating material. This metering by means of a pressure regulator has several disadvantages, in particular when painting automobile bodies or body parts in an automobile painting line. The flow rate of a paint used as a coating material in automobile painting is specifically a function of the viscosity and the pressure. The viscosity of the coating material can to some extent differ considerably in the case of different paint materials. Many paint materials used are thixotropic, meaning that said paint materials have a viscosity which is a function of pressure. This significant correlation between the viscosity of the coating agent and the type of material and the pressure often leads to non-uniform droplet sizes during coating and thus to great difficulties in guaranteeing a homogenous coating.

Embodiments of the present invention improve an application system of the type mentioned at the outset such that a temporally consistent droplet size is ensured during coating procedure. Embodiments of the present invention improve a coating installation.

The improved application system can include the following functional groups: [A] an application apparatus which applies the coating agent, wherein the application apparatus is a printing head which ejects the coating agent from a plurality of coating agent nozzles, wherein one nozzle valve which opens for a valve opening time when a coating agent droplet is to exit the respective nozzle is attached to each individual coating agent nozzle; [B] a coating agent infeed line by way of which the coating agent nozzles of the printing head are collectively connected; [C] a valve control for controlling the valve opening times and valve closing times of each individual valve.

The improved application system can be for coating components with a coating agent. The application system can include the following functional groups: [A] an application apparatus which applies the coating agent, wherein the application apparatus is a printing head (1, 3) which ejects the coating agent from a plurality of coating agent nozzles (2, 4, 19), wherein one nozzle valve (5, 20) which opens for a valve opening time when a coating agent droplet is to exit the respective nozzle (4) is attached to each individual coating agent nozzle (2); [B] a coating agent infeed line (6, 22) by way of which the coating agent nozzles (4) of the printing head (3) are collectively connected; [C] a valve control (25) for controlling the valve opening times and valve closing times of each individual valve (20), wherein the application system furthermore comprises a pump (21) by means of which the coating agent to be applied is fed to the coating agent nozzles (19) by way of the coating agent infeed line (22), and in that the application system is specified such that the pump (21) during coating operates at a constant flow rate of the coating agent, and that the pressure on each nozzle (19) when opening the valve (20) is exactly the same as in the preceding opening of said valve (20).

The above application system can include a coating agent return line (23) in which a return valve (24) which opens at least when the nozzle valves (20) of the printing head (18) are simultaneously closed is installed. The valve control (25) can be specified such that an identical number of nozzle valves of a printing head are always opened during coating. The coating installation can include a robot on which at least the application apparatus is received.

In an embodiment, the application system comprises a pump by means of which the coating agent to be applied is fed to the coating agent nozzles by way of the coating agent infeed line, and the application system is specified such that the pump during coating operates at a constant flow rate of the coating agent, and that the pressure on each nozzle when opening the valve is exactly the same as in the preceding opening of said valve.

According to an embodiment of the invention, the application system has a coating agent return line in which a return valve which opens at least when the nozzle valves of the printing head are simultaneously closed is installed. According to an embodiment of the invention, the valve control is specified such that an identical number of nozzle valves of a printing head are always opened during coating.

FIG. 1 in a schematic and exemplary manner shows a printing head 1 for use in an application apparatus according to an embodiment of the invention. The printing head 1 here in a schematic and exemplary manner is illustrated as a cuboid structure. Said printing head 1 in the example here has ten coating agent nozzles 2 which are disposed in a line behind one another on a narrow side of the printing head, wherein the line extends so as to be approximately perpendicular to the direction of movement of the application apparatus when coating (to this end see FIG. 3). The arrow D shows the direction of ejection of the coating agent droplets.

Figure 2:
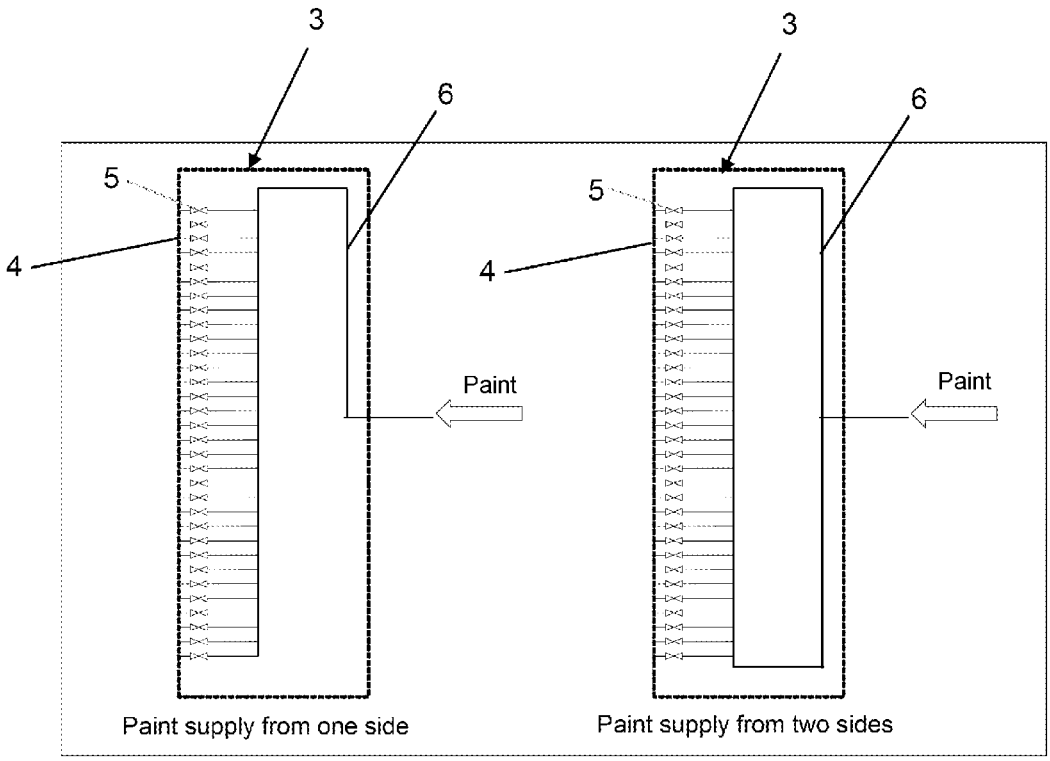
FIG. 2 in a schematic and exemplary manner shows a printing head having thirty-two coating agent nozzles in two embodiments, wherein one valve is attached to each coating agent nozzle and the coating agent nozzles are collectively connected to a coating agent infeed line, on the left having a coating agent infeed from one side, on the right having a coating agent infeed from two sides.

FIG. 2 in a schematic and exemplary manner shows a printing head 3 having thirty-two coating agent nozzles 4 which in terms of construction are substantially identical to the coating agent nozzles 2 according to the embodiment shown in FIG. 1. One valve 5 is attached to each coating agent nozzle 4, and the coating agent nozzles 4 are collectively connected to a coating agent infeed line 6. The valves can be switched at a switching frequency in the range of a few kHz, typically in the range of 3 kHz. An embodiment in which the coating agent is fed only from one side, here from above, is shown on the left in FIG. 2. An embodiment in which the coating agent is fed from two sides, here from above and below, is shown on the right in FIG. 2, wherein the coating agent infeed line 6 to this end branches into an upper and a lower sub-arm 7, 8.

Figure 3:
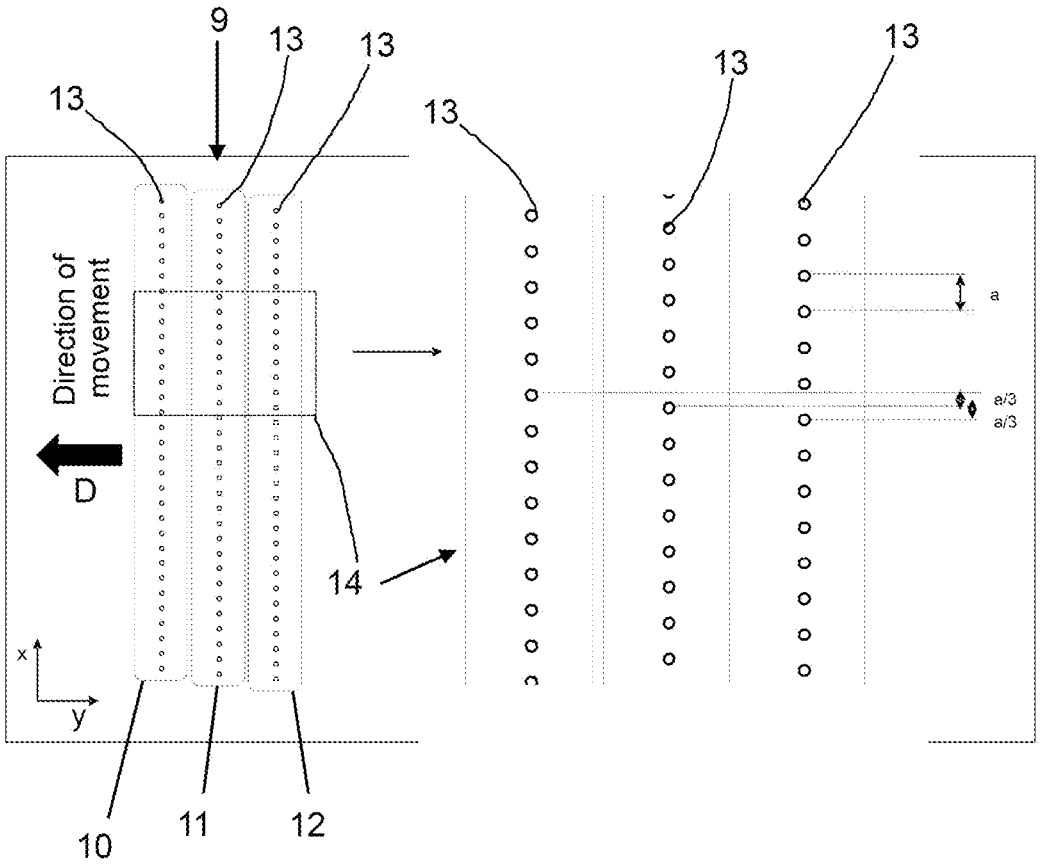
FIG. 3 in a schematic and exemplary manner shows an embodiment of an application system in which three printing heads having in each case thirty-two coating agent nozzles are in a row so as to increase the coating output, and in which the coating agent nozzles in neighboring printing heads are mutually offset.

FIG. 3 in a schematic and exemplary manner shows an embodiment of an application system 9 in which three printing heads, 11, 12 having in each case thirty-two coating agent nozzles 13 are in a row so as to increase the coating output. The direction of movement of the application system 9 during coating is indicated by the arrow P; it can be seen that said arrow P runs so as to be approximately perpendicular to the line in which the coating agent nozzles 13 are disposed in each of the three printing heads, 11, 12. The spacing between neighboring coating agent nozzles 13 is identified by the letter a. For reasons of construction, said spacing cannot be made arbitrarily small. In order for a uniform application of the coating agent to be achieved, the coating agent nozzles 13 of the printing heads, 11, 12 in a row are in each case disposed so as to be mutually offset by an amount of a/3, as is illustrated in the enlarged fragment of a sub-region 14 of the coating agent nozzle area illustrated on the right-hand side in FIG. 3.

Figure 4:
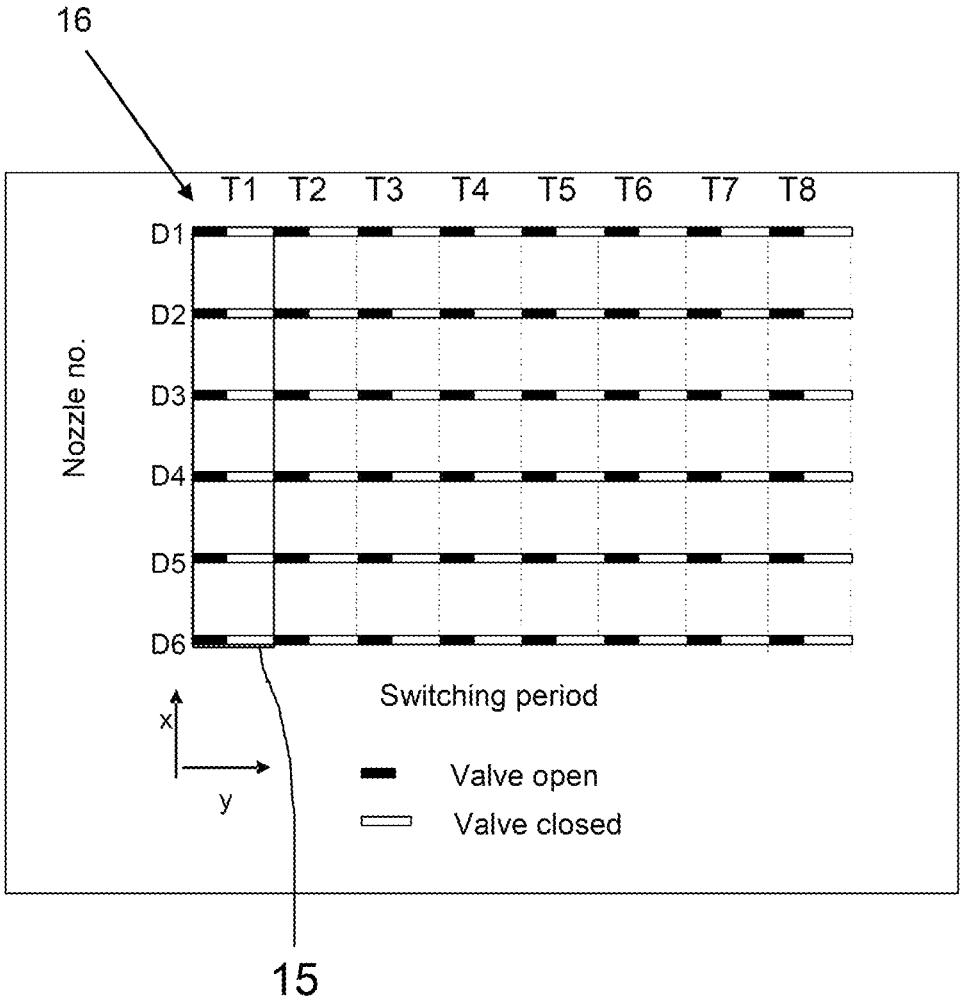
FIG. 4 shows a schematic and exemplary visualization of an operating mode of the coating agent nozzles of a printing head according to the prior art.

FIG. 4 in a schematic and exemplary manner shows the operating mode 16 of the coating agent nozzles of a printing head as is usually applied according to the prior art. A printing head 15 having six coating agent nozzles D1-D6 is assumed here for the exemplary explanation. The horizontally running bars having the alternating black and white areas show the switched state of the respective valves when the printing head 15 is moved for coating. A dark area indicates that the respective valve is open at this point in time; a coating agent droplet exits the respective nozzle during this time. A light area indicates that the respective valve is closed during this time; no coating agent exits through the respective nozzle during this time. In the case of the usual operating mode 16 as is visualized in FIG. 4, all valves are simultaneously opened and closed. This is often performed in order to obtain a sharp line of the coating at the beginning and the end. A total of eight switching periods T1-T8 in the temporally sequential sequence thereof are shown in a row in FIG. 4.

Figure 5:
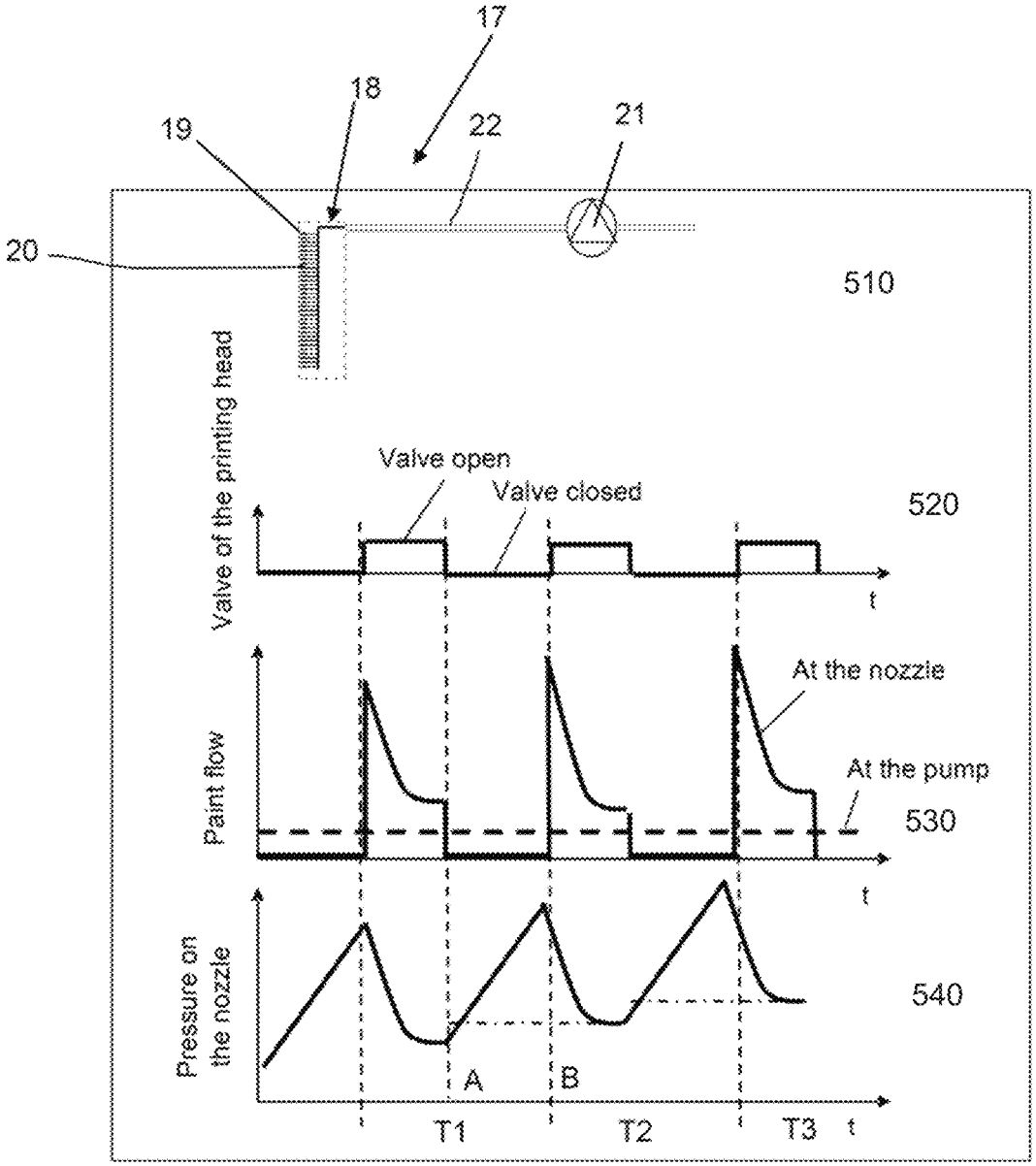
FIG. 5 in a schematic and exemplary manner shows an application system having a printing head which has thirty-two coating agent nozzles, wherein one valve is attached and assigned to each coating agent nozzle.

FIG. 5, at section 510, in a schematic and exemplary manner shows an application system having a printing head which has thirty-two coating agent nozzles, wherein one valve is attached and assigned to each coating agent nozzle. At section 520, FIG. 5 shows an exemplary temporal profile of the valve position during two complete switching periods T1 and T2, as well as during half a switching period T3. At section 530, FIG. 5 shows an exemplary temporal profile of the coating agent flow at the nozzle exit opening of a coating agent nozzle (solid line), and of the flow rate of the coating agent as imposed by the pump (dashed line). At section 540, FIG. 5 shows an exemplary temporal profile of the pressure on the coating agent nozzle of the printing head.

Figure 6:
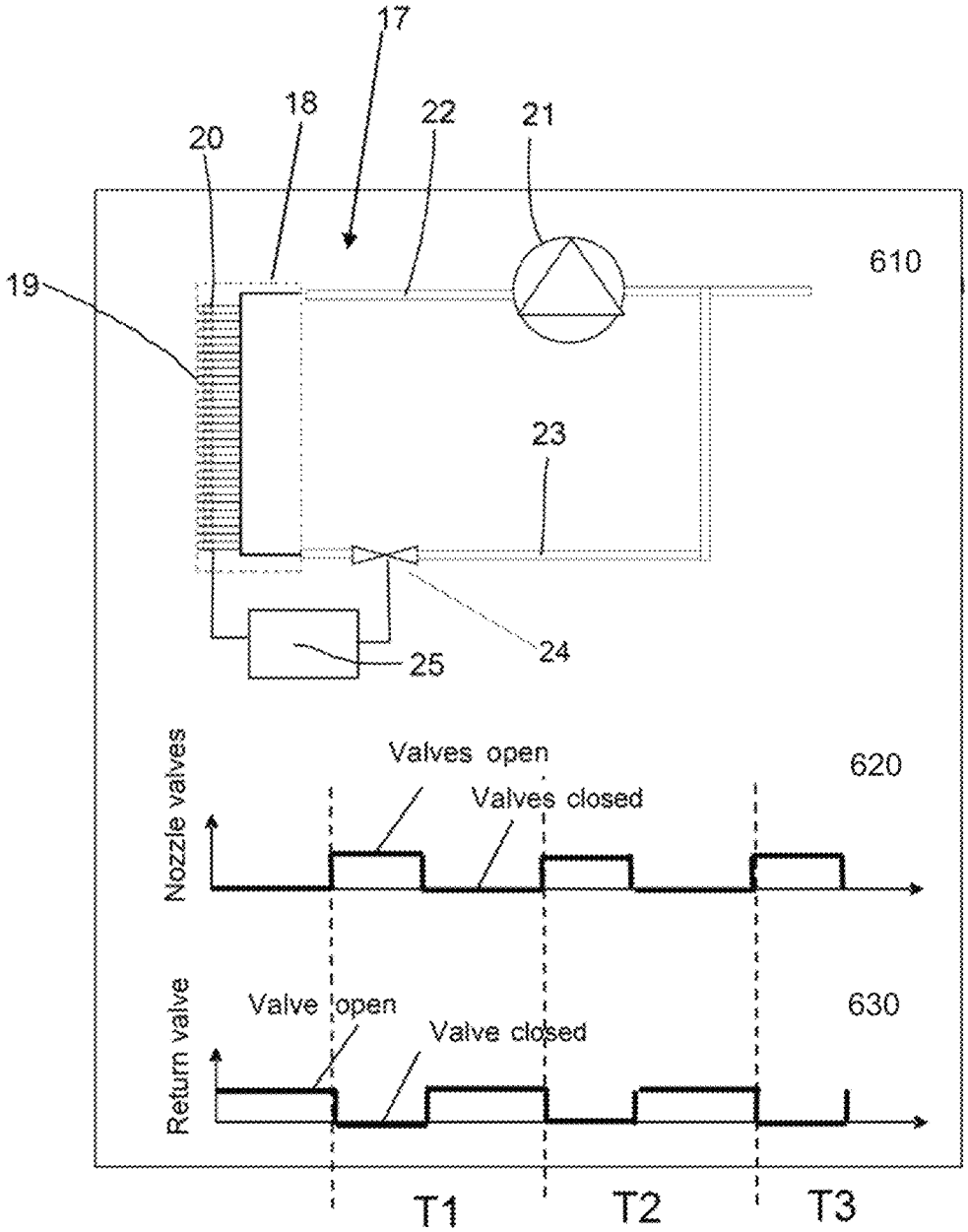
FIG. 6 shows an embodiment corresponding to the one illustrated in FIG. 5, in which a coating agent return line in which a return valve is installed is additionally present.

FIG. 6, at section 610, shows an embodiment corresponding to the one illustrated in FIG. 5 at section 510, in which a coating agent return line in which a return valve is installed is additionally present. At section 620, FIG. 6 shows exemplary switched states of the nozzle valves according to section 610, during two complete switching periods T1 and T2, as well as during half a switching period T3. At section 630, FIG. 6 shows an exemplary switched state of the return valve corresponding to the switched states of the nozzle valves as per section 620, during two complete switching periods T1 and T2, as well as during half a switching period T3.

Figure 8:
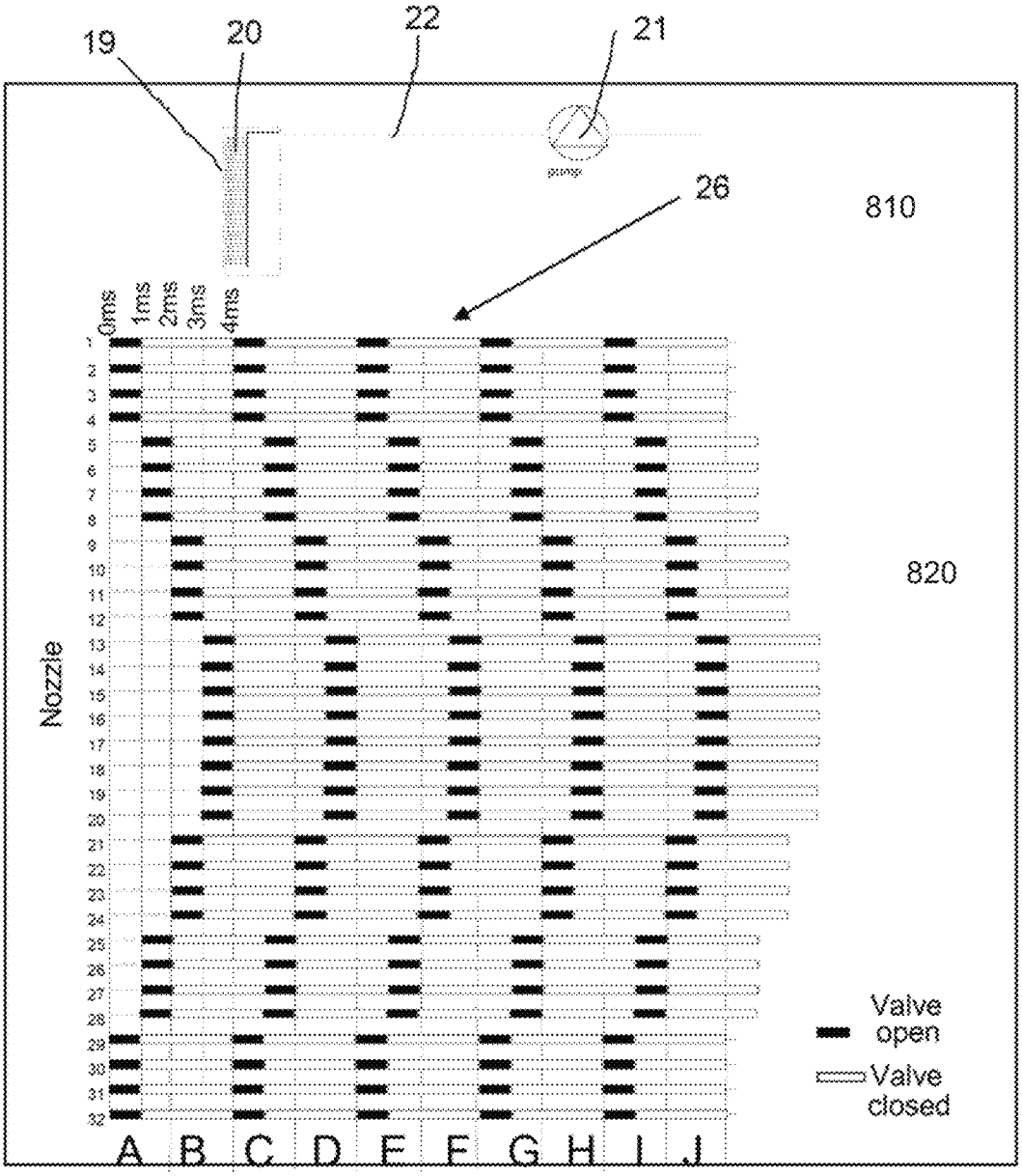
FIG. 8 shows in a schematic and exemplary manner an application system having a printing head which has thirty-two coating agent nozzles, wherein one valve is attached and assigned to each coating agent nozzle.

FIG. 8, at section 810, shows in a schematic and exemplary manner an application system having a printing head which has thirty-two coating agent nozzles, wherein one valve is attached and assigned to each coating agent nozzle. FIG. 8, at section 820, in a schematic and exemplary manner shows the operating mode of the coating agent nozzles of the printing head from section 810, having the thirty-two coating agent nozzles 1-32.

FIG. 5 in a schematic and exemplary manner shows an application system 17 having a printing head 18 which has thirty-two coating agent nozzles 19, wherein one valve 20 is attached and assigned to each coating agent nozzle 19. A pump 21 which pumps the coating agent at a constant flow rate through the coating agent infeed line 22 to the printing head 18 is situated in the coating agent infeed line 22. The pump 21 can be configured as a gear pump or as a piston pump, for example, both being pump types which can generate a constant flow rate even at a variable pressure. FIG. 5 shows the temporal profiles of the valve position (section 520), of the coating agent flow at the nozzle exit opening of a coating agent nozzle (section 530 solid line), of the flow rate of the coating agent imposed by the pump 21 (section 530, dashed line), and of the pressure on the coating agent nozzle 19 of the printing head 18 (section 540) during two complete switching periods T1 and T2 as well as half a switching period T3.

When all the valves are simultaneously closed, for example at the temporal point A in the switching period T1, the pump 21 continues to pump the coating agent at a constant flow rate into the application system 17. The pressure in the application system and thus the pressure on the coating agent nozzle of the printing head increases and a positive pressure is created in the application system (see section 540) since the hoses and other components of the application system have a specific elasticity. When the valve now is opened again at the beginning of the following switching cycle, see temporal point B at the beginning of the switching cycle T2, for example, the pressure decreases again, and the flow of coating agent at the exit opening of the coating agent nozzle becomes constant again after a short time.

It has surprisingly been identified that under certain circumstances, when the temporal constants of the application system are so high that a complete reduction of the positive pressure is not possible up to the beginning of the switching period to follow next, the positive pressure during the next switching period in this instance continues to increase from a higher initial point, and so forth, such that the pressure in the application continues to increase ever more. Since the flow rate of the coating agent at the exit nozzle of the printing head is a function of viscosity as well as pressure, this results in the surprisingly identified problem that, while the pump generates a constant flow rate, the flow rate at the exit opening of the coating agent nozzle and thus the droplet size are not uniform but vary over time.

FIG. 6 shows a first solution to this surprisingly identified problem. An embodiment corresponding to that illustrated in section 510 is shown in section 610, in which a coating agent return line 23 in which a return valve 24 is installed is additionally present. A valve control 25 controls the nozzle valves 20 in the printing head and the return valve 25. Section 620 shows the switched states of the nozzle valves 20, and section 630 to this end shows the corresponding switched state of the return valve 24, in each case during two complete switching periods T1 and T2 and half a switching period T3. The return valve 24 is opened when the nozzle valves 20 are closed, and said return valve 24 is closed when the nozzle valves 20 are opened. The pump 21 pumps by way of the opened return valve 24 and the coating agent return line 23 pumps the coating agent in a circuit when the nozzle valves 20 are closed.

As a result it is achieved on account of this measure that a complete reduction of the positive pressure is henceforth performed up to the beginning of the switching period that next follows closing of all nozzle valves 20, the positive pressure during the next switching period thus increasing again from the pressure level that prevailed at the beginning of the preceding opening of the nozzle valves 20, so that the pressure in the application system does not increase ever more. On account thereof, the flow rate at the exit opening of the coating agent nozzle and thus the droplet size is uniform, not varying over time. This is advantageous with a view to an optimal coating result.

A further solution lies in that the valve control is specified such that an identical number of nozzle valves of a printing head are always opened during coating. FIG. 8 visualizes this solution in an exemplary manner. FIG. 8, at section 810, in a schematic and exemplary manner shows an application system 17 having a printing head 18 which has thirty-two coating agent nozzles 19, wherein one valve is attached and assigned to each coating agent nozzle 19. A pump 21 which pumps the coating agent at a constant flow rate through the coating agent infeed line 22 to the printing head 18 is situated in the coating agent infeed line 22. The pump 21 can be configured as a gear pump or as a piston pump, for example, both being pump types which can generate a constant flow rate even at a variable pressure.

FIG. 8, at section 820, in a schematic and exemplary manner shows the operating mode 26 of the coating agent nozzles of the printing head 18 from section 810, having the thirty-two coating agent nozzles 1-32 according to the second solution according to the embodiment of the invention described here. The horizontally running bars having the alternating black and white areas show the switched state of the respective valves when the printing head 18 is moved for coating. A dark area indicates that the respective valve is open at this point in time, a coating agent droplet exiting the respective nozzle during this time. A light area indicates that the respective valve is closed during this time, no coating agent droplet exiting through the respective nozzle during this time. The valve control ensures that the switching sequence of the valves 20 is set such that a consistent number of valves are always open.

Ten successive switching periods A-J are illustrated in section 820. Eight valves, nos. 1, 2, 3, 4, 29, 30, 31, 32, are open during the first part of the switching period A. The remaining twenty-four valves are closed. When the eight valves nos. 1, 2, 3, 4, 29, 30, 31, 32 close, the eight valves nos. 5, 6, 7, 8, 25, 26, 27, 28 open. At the end of the first switching period A and at the beginning of the second switching period B the valves nos. 5, 6, 7, 8, 25, 26, 27, 28 close again, the valves nos. 1, 2, 3, 4, 29, 30, 31, 32 remain closed, and the eight valves nos. 9, 10, 11, 12, 21, 22, 23, 24 open. When the latter close again in the middle of the second switching period B, the eight valves 13, 14, 15, 16, 17, 18, 19, 20 open. The remaining valves remain closed up to the end of the second switching period B and the beginning of the third switching period C. This routing is repeated thereafter.

In this diagram, eight valves are always open and twenty-four valves closed; the switching routing herein ensures that each of the thirty-two valves has opened once within two switching periods. The pump always operates at a constant flow rate of the coating agent. No increasing positive pressure can build up in the system because eight valves are always opened. In the case of a typical valve opening time of 1 ms and an assumed exemplary speed of the robotic arm of 200 mm/s when coating, the distance covered by the printing head during two switching periods, thus until the same eight valves open as at the beginning, is 0.8 mm. Apart from the switching diagram illustrated in FIG. 8 (e.g., sections 810 and 820), many others are conceivable. For example, not only eight but also sixteen or else only four valves could be simultaneously opened, for instance. The distribution of the opened valves along the line on which said valves are disposed could also vary. It is only important that an identical number of valves are always opened.

Figure 9:
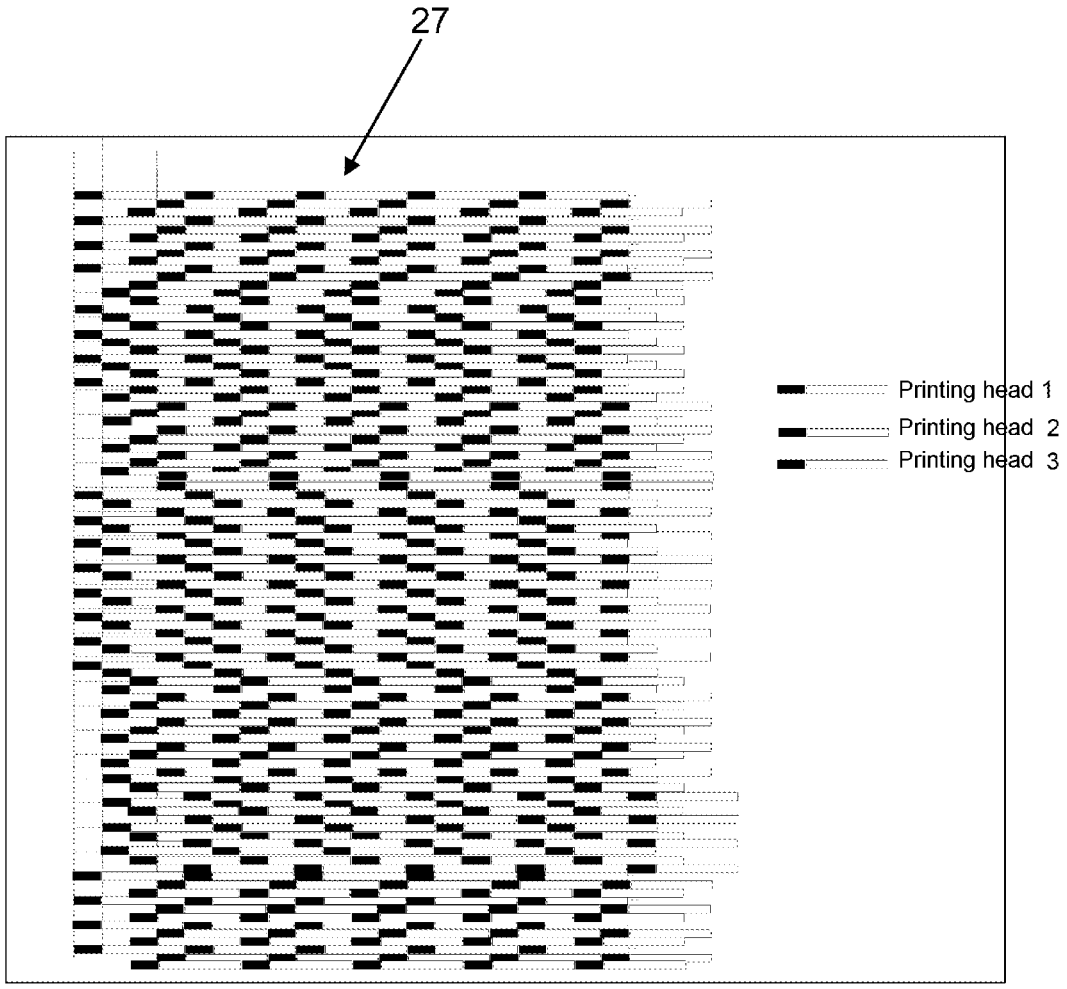
FIG. 9 shows an exemplary operating mode for an application system having three printing heads, each of the latter having thirty-two valves.

The approach shown by means of a printing head in FIG. 8 can also be applied to an application system having a plurality of printing heads. FIG. 9 shows this in an exemplary manner by means of an exemplary operating mode 27 for an application system having three printing heads of which each has thirty-two valves. Here too, the horizontally running bars having the alternating black or hatched, respectively, areas and white areas show the switched state of the respective valves when the printing head is moved for coating. A dark or hatched area, respectively, indicates that the respective valve is open at this point in time, while a coating agent droplet exits the respective nozzle during this time. A light area indicates that the respective valve is closed during this time, no coating agent droplet exiting through the respective nozzle during this time. The bars having the areas filled in black, indicating an opened vale, are assigned to the first printing head. The bars having the obliquely hatched areas, indicating an opened valve, are assigned to the second printing head. The bars having the vertically hatched areas, indicating an opened valve, are assigned to the third printing head.

Here too, it is ensured that eight of the thirty-two valves are opened on each of the three printing heads. Since the three printing heads are operated in parallel, coating agent is ejected from more than eight nozzles in each switching period, specifically from sixteen or twenty-four coating agent nozzles, depending on the switching period. An even better homogeneity of the layer can be achieved in this way.

Figure 7:
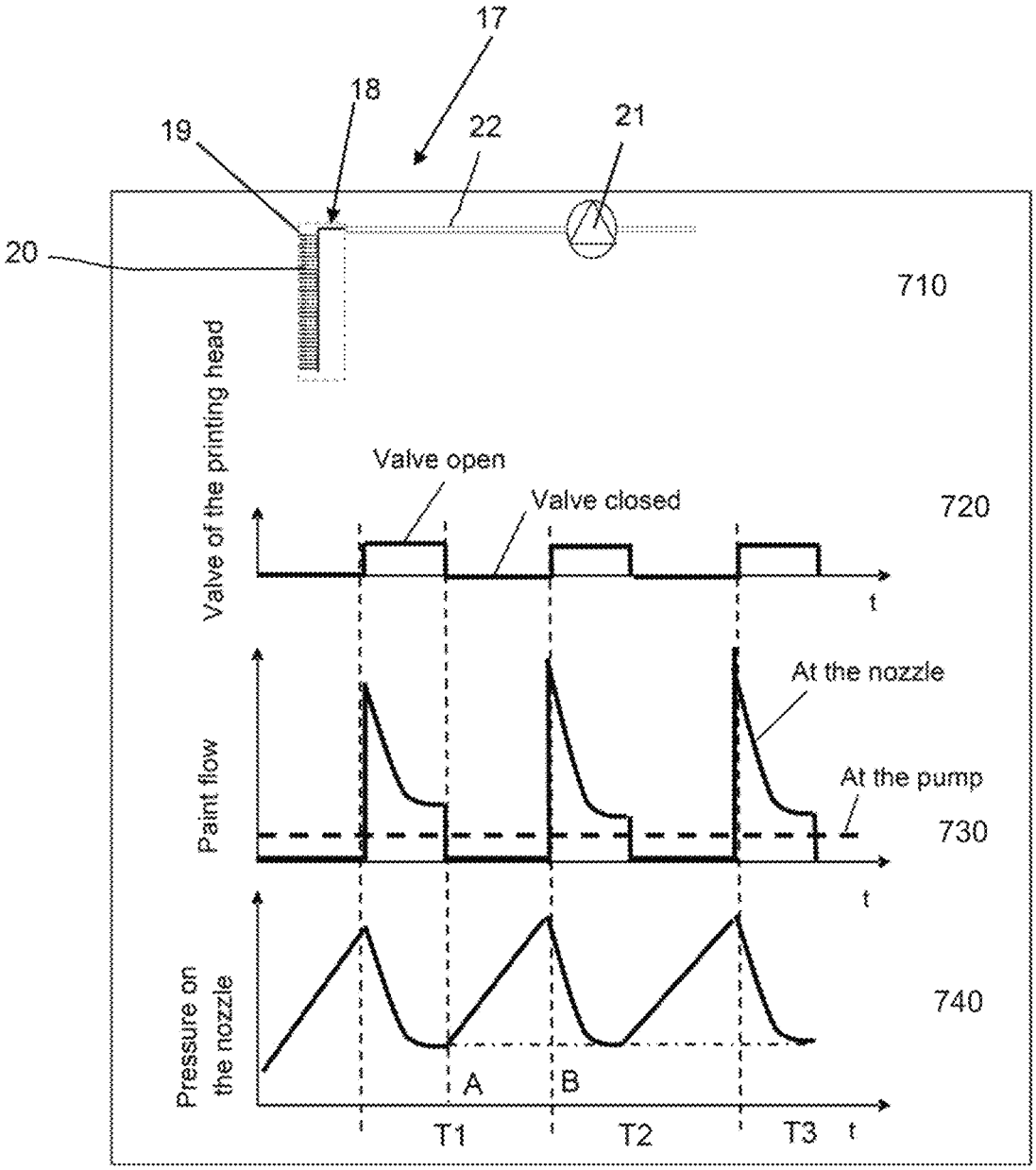
FIG. 7 shows how the disadvantageous build-up of an ever-increasing positive pressure in the system, having the negative effects in terms of a non-uniform droplet size, is avoided by the measures according to an embodiment of the invention.

FIG. 7 shows how the disadvantageous build-up of an ever-increasing positive pressure in the system, having the negative effects in terms of a non-uniform droplet size, is avoided by way of the measures according to the embodiment of the invention as described above. Section 710 in a schematic and exemplary manner shows an application system 17 having a printing head 18 which has thirty-two coating agent nozzles 19, wherein one valve 20 is attached and assigned to each coating agent nozzle 19. A pump 21 which pumps the coating agent at a constant flow rate through the coating agent infeed line 22 to the printing head 18 is situated in the coating agent infeed line 22. The pump 21 can be configured as a gear pump or as a piston pump, for example, both being pump types which can generate a constant flow rate even at a variable pressure. The coating agent return line having the return valve is not illustrated in section 710.

FIG. 7 shows the temporal profiles of the valve position (section 720), of the coating agent flow at the nozzle exit opening of a coating agent nozzle (section 730, solid line), of the flow rate of the coating agent imposed by the pump 21 (section 730, dashed line), and of the pressure on the coating agent nozzle 19 of the printing head 18 (section 740) during two complete switching periods T1 and T2 and half a switching period T3.

In contrast to the correlations explained in the context of section 520, 530, and 540 of FIG. 5, it is achieved upon implementing one of the measures according to an embodiment of the invention that a complete reduction of the positive pressure up to the beginning of the next following switching period has been performed and the positive pressure during the next switching period is in this instance increased again from the same initial pressure as prevailed at the beginning of the preceding switching period, and so forth, so that the pressure in the application system does not increase ever more.

Additional Exemplary Features:

The individual nozzle exit openings for the coating material typically have a diameter of approx. 10 μm to 200 μm.

The individual nozzle exit openings of a printing head are not completely identical on account of production tolerances, wear, or deposits, respectively. Each of the nozzle exit openings that is actuated by a valve therefore has a different flow resistance. The material quantity $\dot{V}_i$ flying through the nozzle exit opening i is a function of the pressure ahead of the exit opening $p_i$. This correlation is described by the first function or the inverse second function, respectively.

$$\dot{V}_i = f_i(p_i) \quad \text{First function:}$$

$$p_i = g_i(\dot{V}_i) \quad \text{Second function:}$$

In the constructive design embodiment of a printing head attention is paid to the pressure always being identical at all nozzle exit openings, that is to say that the pressure loss in the coating agent infeed line should be negligible. It is to be noted that the functions $f_i$ or $g_i$, respectively, depend on the viscosity and thus on the coating material being applied.

In a first approximation it can be assumed that the functions described above are linear in the region of interest. The equation for the nozzle exit opening appears below. In the equation, $k_i$ is a characteristic value of the exit opening and vis the viscosity of the material.

$$\dot{V}_i = \frac{k_i}{v} p$$

The printing head is moved at a constant speed across the surface to be coated. A mean paint flow rate, in the case of the coating agent being a paint, or a mean coating agent flow rate, respectively, results from the material properties, the layer thickness to be achieved, and the spacing between the exit openings.

$$\dot{V}_m = \frac{\mu \cdot d_D v_a}{f_V}$$

In the above equation: $\dot{V}_m$ is paint flow rate per nozzle, $d_D$ is spacing between the nozzles perpendicularly to the direction of movement (spacing resulting in the case of a plurality of applicators disposed behind one another), μ is layer thickness (dry film), $f_V$ is volumetric solids content of the material applied, and $v_a$ is speed of the applicator (TCP speed).

The switching frequency, or the time of period (from opening the valve to the next opening), respectively, $T_p$ and the time $T_v$ for which the valve is opened, are experience values.

The paint flow rate through a nozzle exit opening in terms of an approximation is described by the following correlation:

$$\dot{V}_D = \frac{T_D}{T_v} \dot{V}_m$$

The volume of coating agent ejected in the case of a valve opening (droplet volume) is described by the following correlation:

$$V_T = \dot{V}_m \cdot T_D = \frac{\mu \cdot d_D v_a}{f_V} \cdot T_D$$

In terms of a homogenous coating it is an objective that the same quantity of coating material flows through all nozzle exit openings in a temporal mean. This can be achieved in that the individual valves are opened for dissimilar durations.

The approach in the case of the pressure loss in the distributor line being negligible is then the following.

In the first step, the characteristic line $\dot{V}_i = f_i(p_i)$ or $p_i = g_i(\dot{V}_i)$, respectively, is determined for each exit opening. In the case of the linearity described above, the characteristic values $k_i \ldots k_n$ are obtained, where:

$$\bar{k} = \frac{1}{n} \sum_{i=1}^{n} k_i$$

The following applies to the variant of the coating material supply by way of a material pressure regulator:

Predefined value(s) include: (i) paint quantity per valve opening and/or (ii) mean valve opening time. The material pressure to be set at the material pressure regulator and the valve opening time result as follows:

$$p = \frac{v}{\bar{k}} \dot{V}_D$$

$$\frac{T_i}{T_v} = \frac{\bar{k}}{k_i}$$

The valve opening time is indirectly proportional to the characteristic value.

The following applies in the case of the coating material supply being performed by way of a metering pump, for example:

The advantage of using a metering pump in a coating installation is that the fluidic conditions in the entire application system are independent of the viscosity of the coating agent and no setting of parameter values to the coating material used in each case has thus to be performed.

Since the pump operates at the same coating agent rate during the entire time, in the case of the coating agent being paint thus at a constant paint flow rate, the coating agent pressure, or the paint pressure, respectively, depends on how many valves are opened. The fewer valves opened, the higher the pressure. The temporal differences between the individual valve switching times are thus smaller than in the case of an operation at constant pressure.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Printing head
2 Coating agent nozzle
3 Printing head
4 Coating agent nozzle
5 Valve
6 Coating agent infeed line
7 Sub-arm
8 Sub-arm
9 Application system
10 Printing head
11 Printing head
12 Printing head
13 Coating agent nozzle
14 Sub-region
15 Printing head
16 Diagram of an operating mode
17 Application system
18 Printing head
19 Coating agent nozzle
20 Valve
21 Pump
22 Coating agent infeed line
23 Coating agent return line
24 Return valve
25 Valve control
26 Operating mode
27 Operating mode

What is claimed is:

1. An application system for coating components with a coating agent, the application system comprising:

an application apparatus configured to apply the coating agent, wherein the application apparatus comprises a printing head that ejects the coating agent from a plurality of coating agent nozzles, wherein a nozzle valve, which opens for a valve opening time when a coating agent droplet is to exit the respective nozzle, is attached to each individual coating agent nozzle;

a coating agent infeed line configured to collectively connect the plurality of coating agent nozzles of the printing head;

a valve control configured to control the valve opening times and valve closing times of each individual valve, wherein the valve control is configured to maintain a constant number of nozzle valves of the printing head to always be opened during coating based on closing a first set of nozzle valves, of the plurality of coating agent nozzles, when a second set of nozzle valves, of the plurality of coating agent nozzles, are opened; and a pump configured to feed the coating agent to the plurality of coating agent nozzles via the coating agent infeed line, and wherein the application system is configured such that the pump during the coating operates at a constant flow rate of the coating agent, and that the pressure on each nozzle when opening the valve is the same as in the preceding opening of the valve.

2. The application system of claim 1, comprising a coating agent return line in which a return valve which opens at least when the nozzle valves of the printing head are simultaneously closed is installed.

3. A coating installation for coating components with a coating agent, the installation comprising:

the application system of claim 1, and a robot configured to receive at least the application apparatus.

4. The application system of claim 1, wherein the valve control is configured to maintain the constant number of nozzle valves of the printing head to always be opened during coating by:

closing the first set of nozzles at a first switching period; and opening the second set of nozzles at the first switching period, wherein the first set of nozzles and the second set of nozzles comprise a same number of nozzles.

5. The application system of claim 1, wherein the valve control is further configured to maintain the constant number of nozzle valves of the printing head to always be opened during coating by:

closing the second set of nozzles at a second switching period; and opening a third set of nozzles at the second switching period, wherein the first set of nozzles, the second set of nozzles, and the third set of nozzles comprise the same number of nozzles.

* * * * *